United States Patent [19]

Quaney

[11] 4,330,969

[45] May 25, 1982

[54] CONSTRUCTION PANEL

[76] Inventor: Patrick E. Quaney, Fountain Valley, Calif.

[21] Appl. No.: 165,414

[22] Filed: Jul. 3, 1980

Related U.S. Application Data

[63] Continuation of Ser. No. 927,013, Jul. 24, 1978, abandoned.

[51] Int. Cl.[3] ..... E04B 1/32

[52] U.S. Cl. ..... 52/81; 52/309.4; 52/584; 52/602

[58] Field of Search ..... 52/81, 80, 82, 584, 52/602, 309.4, 309.8; 264/328.1, 328.2, 328.4

[56] References Cited

U.S. PATENT DOCUMENTS

| | | | |
|---|---|---|---|
| 2,114,048 | 4/1938 | Davis | 52/602 X |
| 2,736,072 | 2/1956 | Woods | 52/81 |
| 2,847,712 | 8/1958 | Pollard et al. | 264/328.4 |
| 3,026,651 | 3/1962 | Richter | 52/81 |
| 3,042,050 | 7/1962 | Finlayson | 135/1 |
| 3,107,234 | 10/1963 | Stewart | 264/328.4 |
| 3,296,755 | 1/1967 | Chisholm | 52/81 |
| 3,300,916 | 1/1967 | Pritzker | 52/81 |
| 3,468,083 | 9/1969 | Camoletti et al. | 52/81 |
| 3,564,791 | 2/1971 | Arp | 52/602 |
| 3,763,608 | 10/1973 | Chamlee | 52/80 |
| 3,918,233 | 11/1975 | Simpson | 52/81 X |
| 4,048,770 | 9/1977 | McKenzie | 52/81 |
| 4,249,881 | 2/1981 | Oppl et al. | 264/328.1 |

FOREIGN PATENT DOCUMENTS

| | | | |
|---|---|---|---|
| 292650 | 9/1967 | Australia | 52/81 |
| 1134304 | 12/1956 | France | 52/602 |
| 1387829 | 3/1975 | United Kingdom | 52/81 |

OTHER PUBLICATIONS

Science News Letter, Jan. 2, 1960, vol. 77, No. 1, p. 7.

*Primary Examiner*—Alfred C. Perham
*Attorney, Agent, or Firm*—Hubbell, Cohen, Stiefel & Gross

[57] ABSTRACT

A panel of a predetermined geometric shape for use in the construction of buildings and enclosures. The panel is a cast or molded component having a base portion which forms an interior or exterior wall surface for the structure with which is integrally molded a flange extending entirely around the periphery of the base member. The flange is positioned at a 90° angle to the base member or is slightly angled to permit convenient assembly on a flange-to-flange basis with adjacent panels. Optionally, reinforcing ribs and a central boss are integrally formed into and raised from the base portion. Panels, when molded in a triangular configuration, are particularly suited for construction of geodesic domes. Apertures are provided extending through the flanges to permit fasteners to be passed between them and to thereby secure flanges of adjacent panels together. In some embodiments, an auxiliary or facing panel is secured to the flanges and the boss to provide a smooth, continuous surface to both sides of the panel.

3 Claims, 17 Drawing Figures

CONSTRUCTION PANEL

This is a continuation of application Ser. No. 927,013 filed July 24, 1978, now abandoned.

BACKGROUND OF THE INVENTION

The present invention relates to structural elements and, more specifically, to a one-piece molded panel suitable for assembly with other panels of a similar shape on a flange-to-flange basis.

Heretofore, the manufacture of pre-fabricated structural modules or panels has involved assembly of conventional construction components on an assembly line basis. In this approach, modules or panels are framed using conventional construction materials according to a predetermined shape or geometric outline. To the framed shape or outline is applied paneling of conventional interior or exterior covering materials to produce the construction panel or module. The modules or panels are then shipped to the construction site and assembled by erecting and fastening the panels to adjacent panels. Because such panels are constructed of a number of individual framing and subpaneling elements, their strength is limited due to the inherent strength limitations of assemblies. Constructed as they are from conventional construction materials, the fixed cost of such panels or modules is also relatively high.

The prior art includes extensive disclosures of various types of pre-fabricated panels for use in construction. Depending upon the type of structure to be erected, the panels typically have characteristic geometric shapes. In the construction of conventional rectangular or box-like structures, the construction panels are rectangular or square. In the construction of spherical buildings, such as geodesic domes, the panels are typically triangular, tetrahedral and, in many instances, are curved about a bisecting axis. Representative of such types of panels are those shown in U.S. Pat. Nos. 3,026,651 and 3,296,755. Still another type of panel is that shown in U.S. Pat. No. 2,736,072.

In addition to the strength and cost problems outlined above, another difficulty with such prior art panels is that the individual panels are characterized by a number of fabrication and assembly steps in order to obtain the basic panel or module of the building unit, thus, further increasing the fixed cost of such units. In some instances, the building units may be required in many different sizes and shapes, thus also increasing the cost and difficulty of using such a system. In some instances where generally uniform panels have been utilized, the attachment of adjacent panels has been characterized by elaborate and costly mechanisms, such as hinging and the like requiring skilled, time-consuming assembly on the actual building site.

SUMMARY OF THE PRESENT INVENTION

The present invention provides a basic building unit panel, the fabrication of which is greatly simplified by utilizing molding or casting techniques. In the presently preferred embodiment of the invention, a plurality of identical building panel units are fabricated by molding such panels of structural foam or similar materials. The result is a very high strength building panel unit requiring a minimum of fabrication equipment, namely, a single mold or, at the most, three molds, one for molding the basic panel, one for molding a facing panel to be used with the basic panel to give the panel unit an inside or an outside skin, and one for molding a base plate to secure the structure to the foundation.

The present invention provides a structural element for use in the construction of a geodesic dome comprising a first panel molded in one integral piece from a moldable material. The panel includes a base portion and a flange which is integrally formed with the base portion and extends around the periphery of the base portion. The flange extends to one side from the plane of the base portion and is inclined with respect to the plane of the base portion.

In an alternate embodiment of the panel of the present invention, reinforcing ribs and a centrally-located boss are also integrally molded into the basic base portion-flange configuration. The boss and ribs can be molded into either side of the panel by simple modification or substitution of the molding components used. When the mold is modified to provide such a centrally-located boss, this portion of the mold provides a convenient sprue through which the material of the panel flows during molding. Likewise, the mold modifications to provide ribs provide convenient runners through which the panel material flows to the extremities of the panel during molding.

The centrally-located boss provides a convenient point of support for a facing panel when such a panel is used with the panel of the present invention. At the same time, the ribs strengthen and further enhance the overall structural integrity of the panel of the present invention. Once molded into the panel, the boss and ribs can then be trimmed or tailored as desired to suit specific decorative or structural needs.

When molded in a triangular shape, the panel of the present invention provides an ideal unit for the construction of spherical structures, such as geodesic domes. In assembly, the panels are attached flange-to-flange and secured together by fasteners passing through adjacent flanges or by bonding. No assembly components are required other than fasteners passing through the flanges of the adjacent panels. A sealer may be used to caulk and seal the line of abutment between adjacent panels for enhanced weatherproofing.

In the presently preferred embodiment, the panel of the present invention is molded from that group of materials now known as structural foam. The basic structural foam or similar structure is easily modified to accept window and door units and other elements of conventional construction, including utility lines, wiring, plumbing and the like. Structural foam panels are easily cut, sawed and drilled to permit modification in preparation for addition of such other structural components.

In addition to fastening panels by means of conventional mechanical fasteners, structural foam also lends itself to bonding and joinder by other means, such as sonic, chemical and mechanical bonding.

As indicated above, the invention provides a greatly simplified means of pre-fabrication involving one or, at most, three standard molds. The invention is also characterized by significantly streamlined and simplified requirements in terms of erection of a structure, since the assembly on the site entails essentially only the assembly step of placing adjacent panels in a side-by-side, flange-to-flange relationship and thereafter securing the flanges together.

Such an approach eliminates the struts, gussets, reinforcing elements, supports and the like characteristic of the prior art approaches to modularized or panelized construction. The panels of the present invention are flat and uniform in size and shape, facilitating shipping, replacement and interchangeability. Reduced or essentially eliminated also is the painstaking and tedious assembly of the prior art pre-fabricated structures involving, as the prior art does, panels and modules of different sizes and shapes and a variety of other assembly components.

DESCRIPTION OF THE DRAWINGS

These and other advantages of the present invention will be better understood by reference to the figures of the drawing wherein.

DESCRIPTION OF A SPECIFIC EMBODIMENT

Figure 1:
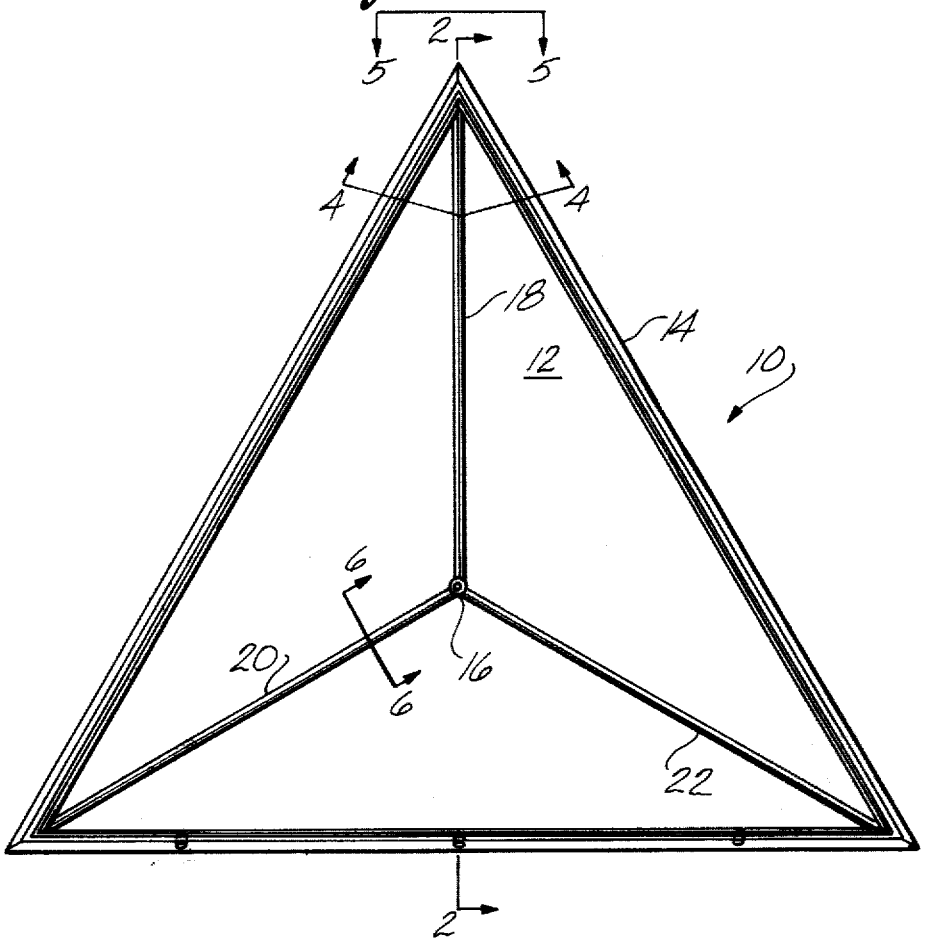
FIG. 1 is a plan view of a triangular-shaped panel according to the present invention.

A panel 10 according to the present invention is shown in plan view in FIG. 1. As shown therein, the panel 10 is triangular in configuration having a base portion 12 and an integral peripheral flange 14. A boss 16 is located on and raised from one surface of portion 12 approximately in the center thereof. Extending from the boss to each corner of the triangle are three ribs 18,20,22 integrally formed with the boss, base portion and flange.

Figure 2:
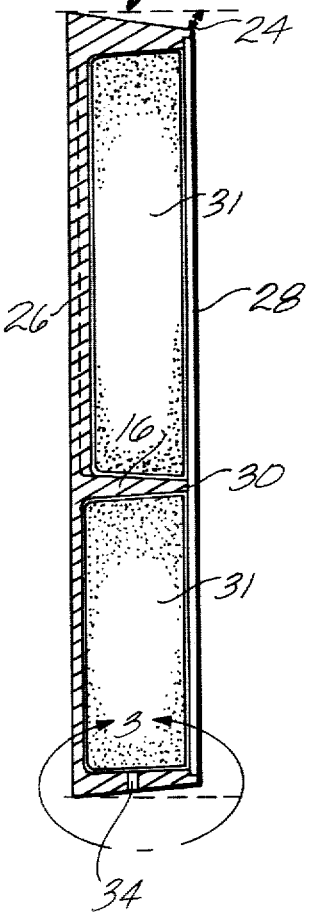
FIG. 2 is a sectional view along lines 2—2 of FIG. 1 with a facing panel and insulating material shown added.
Figure 3:
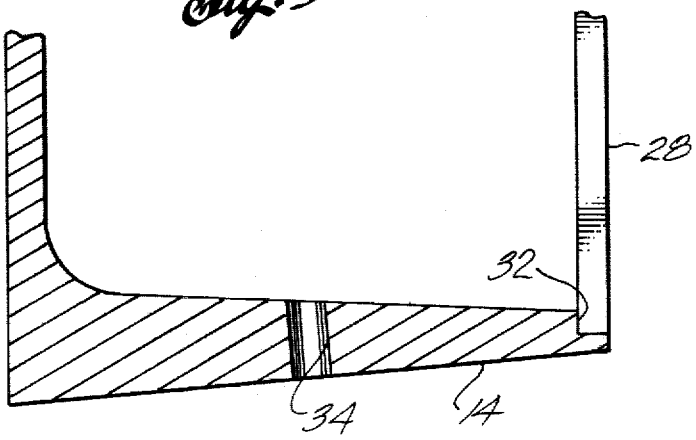
FIG. 3 is an enlarged detail view of a portion of the sectional view in FIG. 2.

As is better illustrated in FIGS. 2 and 3, the exterior surfaces of flange 14 are canted inwardly at a predetermined angle to facilitate the assembly of adjacent panels in a flange-to-flange arrangement, causing the structures to assume a curved configuration resulting in spherical structure. As will be discussed more specifically below, the specific measurement of angle 24 is determined by the diameter of the structure to be erected and the physical size of each individual panel. As can be seen from FIG. 2, the base member 12 provides an exterior skin 26 which is the exterior/outer surface of the structure. It is possible to construct the panel according to the present invention such that the flanges 14 face interiorly or exteriorly. In the embodiment shown in FIGS. 1–5, the panel is set up with an interior flange construction. Located on the interior side of the panel is a facing panel 28 which, in the presently preferred embodiment, is assembled to the panel 10 by securing it by means of gluing or chemically bonding to the end of boss 16 and around its outer edge to flanges 14. Optionally, where removal of panel 28 is desired, the facing panel is secured to panel 10 by means of removable fastener. Flange 14 is stepped along its outer surface to provide a shoulder 32 for receiving panel 28 and holding it securely in position. As is indicated in FIGS. 1, 2 and 3, apertures 34 are provided in flange 14 for receiving fasteners and securing adjacent panels together. As shown in FIG. 2, insulation 31, such as fiber glass or rock wool, is placed in the cavity defined between panel 10 and panel 28, prior to bonding, to enhance the thermal barrier properties of a typical panel according to the present invention.

Figure 4:
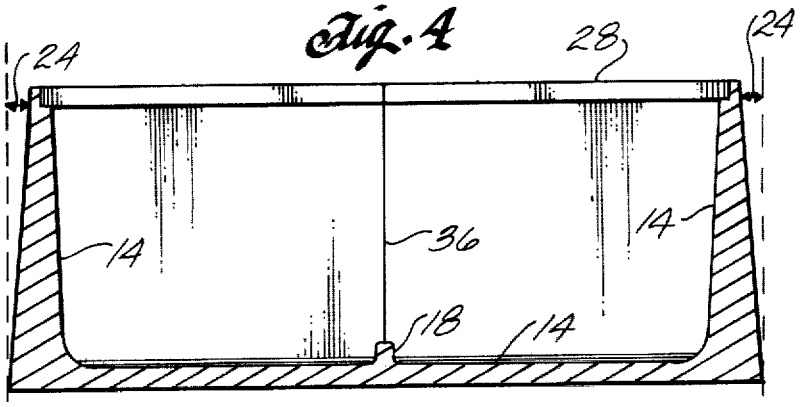
FIG. 4 is a sectional view taken along lines 4—4 of FIG. 1.

The panel according to the present invention is further illustrated by the sectional view in FIG. 4 taken along lines 4—4 of FIG. 1. As shown therein, the base member 14 has a rib 18 extending therealong to the apex 36 of the triangular panel. Flange 14 extends inwardly at an angle 24 from the vertical. The inward cant of the sides of the flanges facilitate assembly of the panels of the present invention in a geodesic dome configuration. Facing panel 28 is likewise shown in FIG. 4.

Figure 5:
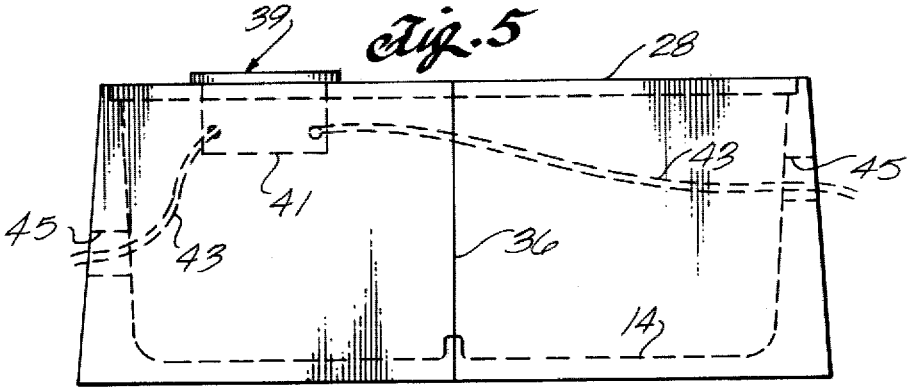
FIG. 5 is an elevational view of the panel of FIG. 1 taken along lines 5—5 thereof with modifications illustrating the manner in which utilities are provided.

In FIG. 5, a view taken along lines 5—5 of FIG. 1, is shown the exterior apex 36 with the interior of the flanges, the facing panel and rib shown in phantom. A typical electrical fixture 39 is shown mounted in facing panel 28 in FIG. 5. The fixture 39 shown is an electric wall plug which is mounted in an opening cut into panel 28 to receive the housing 41 of the wall plug. The plug is connected to the remainder of the electrical system for the structure by means of electrical conductors 43. The conductors extend through apertures 45 provided or drilled through flange 14 and ultimately extend back to the power panel providing electric service to the structure. As can be seen from FIG. 5, the panels and flanges are drilled and cut much like wood or other construction materials to provide the necessary space for extending the water, power, phone and other utility lines throughout the structure. Under normal circumstances, the electrical, plumbing, etc. lines are put in place during the erection process and prior to the emplacement of the facing panels.

Figure 6:
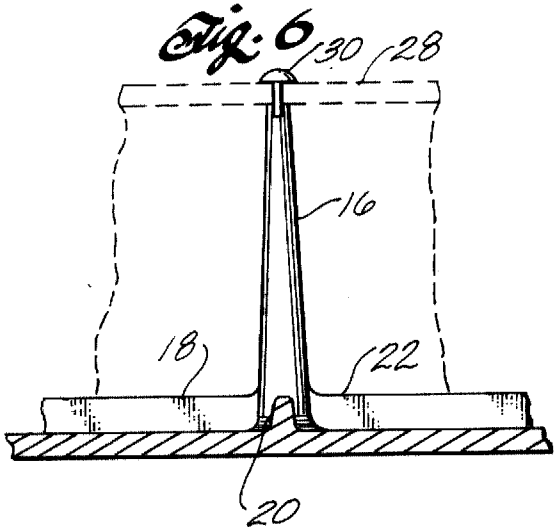
FIG. 6 is an enlarged detail view of the boss located in the center of the triangular panel of FIG. 1 showing an alternate means of fastening a facing panel.

In an alternate embodiment, facing panel 28 is secured to panel 10 by means of a fastener passing through the panel into boss 16. A detail view of the assembly of facing panel 28 by means of fastener 30 to boss 16 is shown in FIG. 6. As shown therein, the interior of boss 16 is threaded to receive fastener 30 and hold panel 28 secure against the top of the boss.

Figure 7:
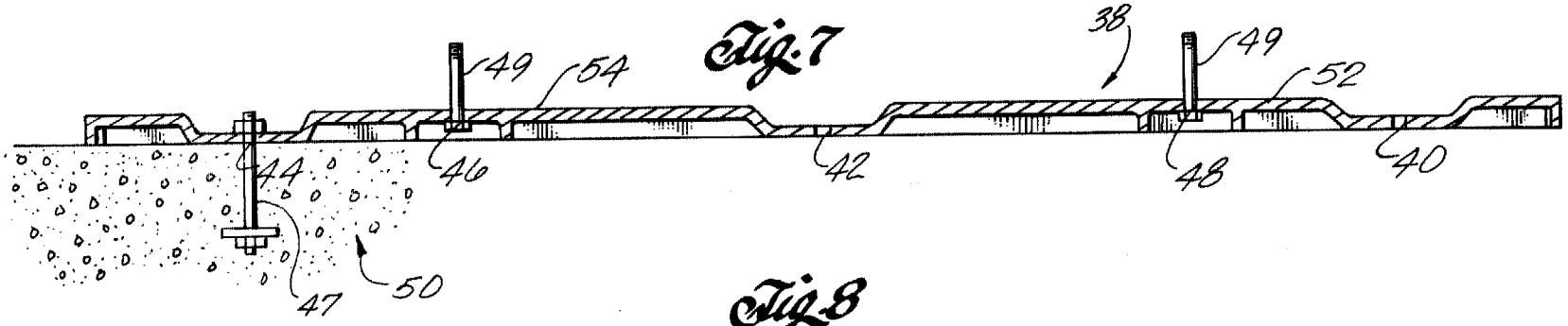
FIG. 7 is an elevational view of a ground a base plate unit for use with the panel of the present invention.
Figure 8:
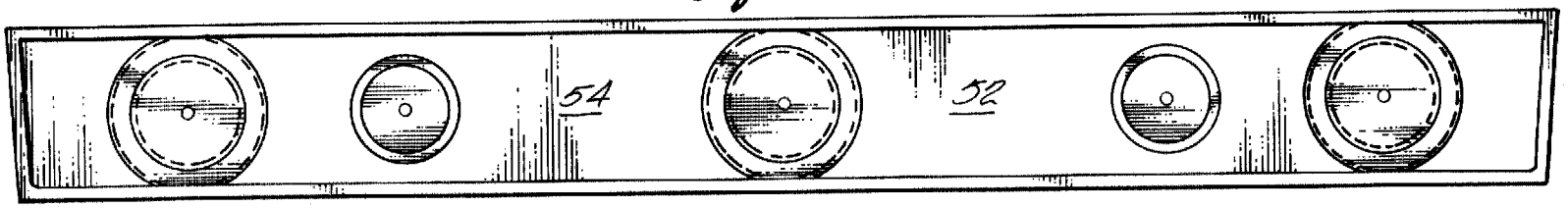
FIG. 8 is a plan view of the base plate unit of FIG. 7.

The base plate 38 whereby the panels of the present invention are secured to a slab or foundation is shown in FIGS. 7 and 8. As shown therein, fasteners 47 are passed through apertures 40,42,44 into concrete or the like for securing plate 38 in position. Apertures 46,48 are located in plate 38 spaced from the foundation or concrete footing 50 to receive fasteners 49 for securing the flanges of the panels according to the present invention to the elevated surfaces 52,54 of the base plate.

Figure 9:
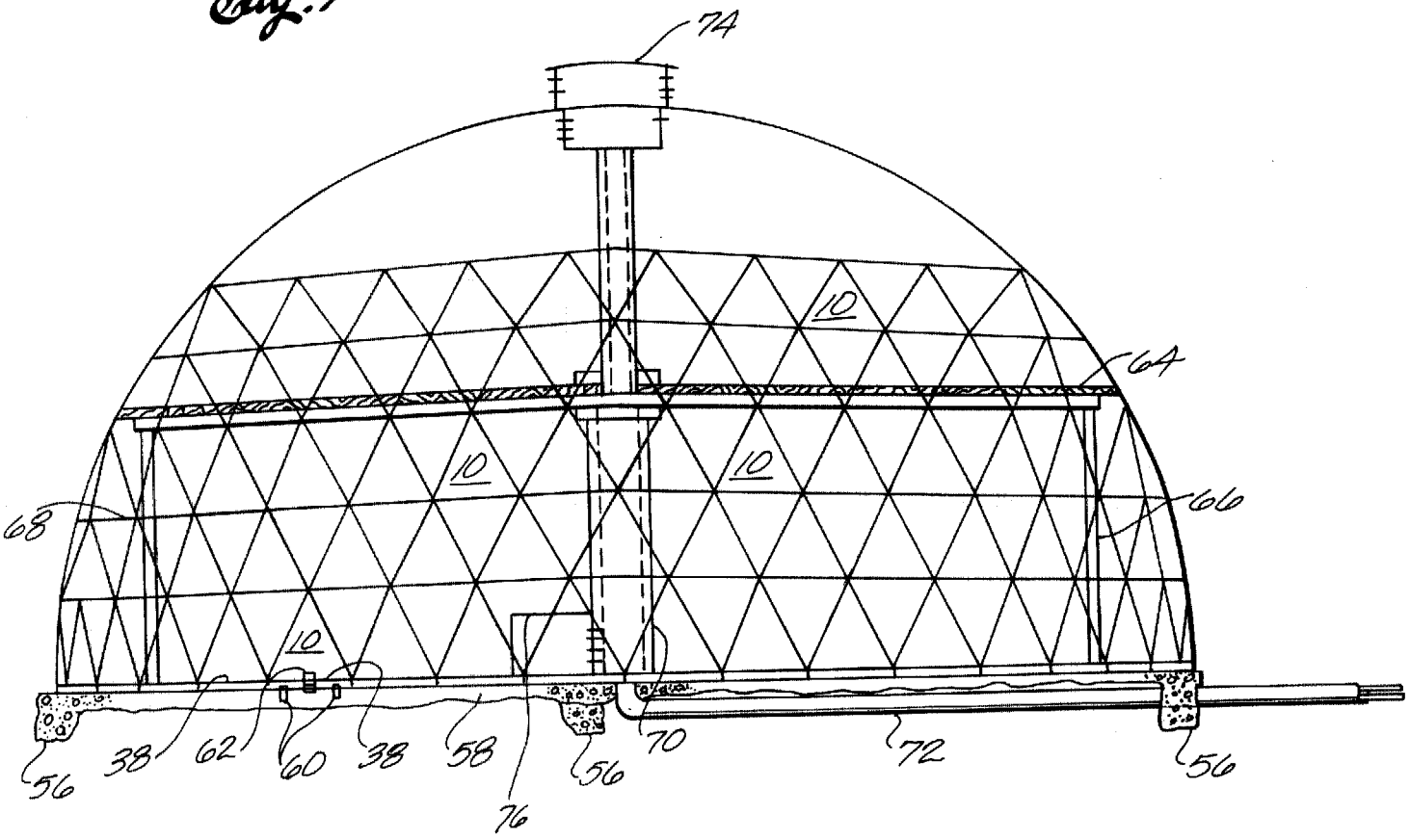
FIG. 9 is an elevational view of a geodesic structure utilizing the panel of FIG. 1.

Use of the panel of the present invention in the construction of a geodesic dome is illustrated in FIG. 9. As shown therein, a plurality of panels 10 are indicated in diagrammatic form. Concrete footings 56 are first poured and thereafter a base plate 38 is secured to the concrete floor 58 which is poured over the concrete footings. A base plate 38 is provided for each panel unit 10. Fasteners 60 secure base plate 38 to the concrete flooring 58 and fastener 62 secures panel unit 10 to the base plate.

As shown in FIG. 9, the structure is a two-story structure. The flooring 64 for the second story structure is supported by floor supports 66,68 and a central column support 70. Column 70 is a hollow column which provides service access to the second floor and a conduit for electric lines, water lines, sewage, heating and air conditioning. A service conduit 72 extends from the base of column 70 exteriorly through the flooring and exteriorly of the structure for connection to municipal hook-ups for power, water and sewage.

If desired, panels can be attached to floor supports 66 for dividing the rooms on the first floor in conventional, vertical wall configurations. Furnace, heating and air conditioning equipment 74 is installed at the top of the dome extending between the interior and the exterior of the dome to provide intake and exhaust ventilation ports and supply and return venting registers for the interior of the structure. Alternatively, such equipment is located at the base of column 70 in housing 76 or at some other convenient location in the structure.

Figure 10A:
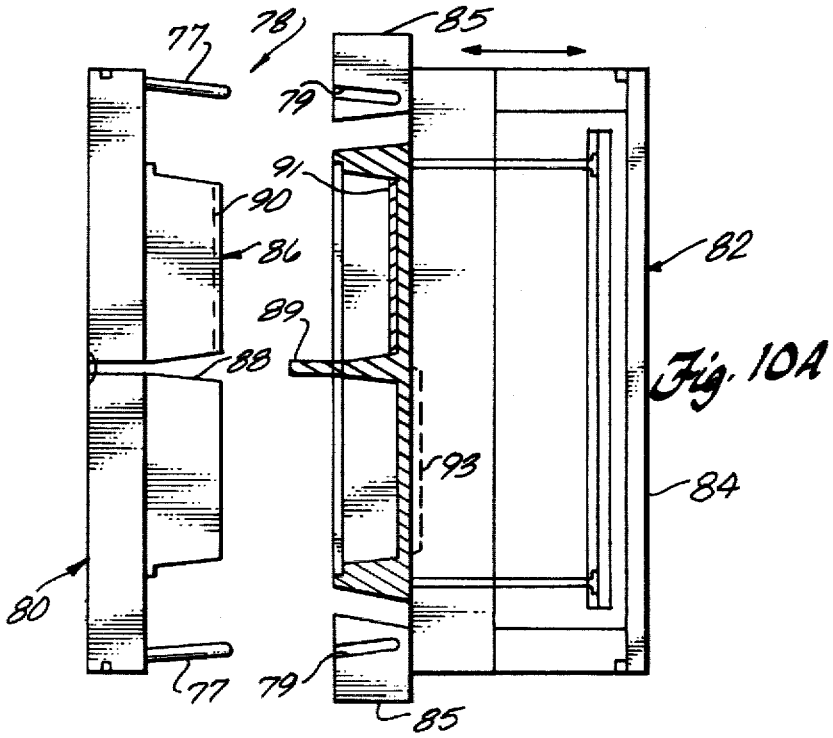
FIG. 10A is a diagrammatic illustration of a mold used for fabrication of the panel according to the present invention having an inwardly-canted flange (negative draft)

One embodiment of a mold for fabricating the panel according to the present invention is shown in FIG. 10A. Mold 78 comprises a hot mold half 80 and an ejector mold half 82. The ejector mold half 82 has a base plate 84 and movable slide blocks 85 which cooperate to define a cavity conforming to the outside surface of the panel and flanges. The number of slide blocks 85 normally corresponds to the number of discrete sides to the panel to be molded, e.g. three for a triangular panel and four for a square or rectangular panel. Mold slides 85 are used when the outside surfaces of the flanges are inwardly canted and the mold has a negative draft. The opposite side of the panel is defined by a mold insert (core) 86 secured to mold half 80 containing a sprue 88 for transmitting the structural foam to the mold cavity. Slide pins 77 are also provided on mold half 80 for engaging receptacles 79 in slides 85. As shown therein, mold half 86 defines a recess or runner 90 which extends from the sprue 88 to the flanges of the panel. As can be seen from FIG. 10A, the sprue hole 88 and column define a boss 89 raised from the base portion of the panel of the present invention when the mold is opened and the panel removed. Likewise, the runners 90 transmitting the moldable material to the base and flanges of the panel define ribs 91 which lend strength and rigidity to the finished panel. In an alternate embodiment, runners such as runner 93 is provided in mold half 82 on the side of the panel opposite rib 91 for optionally providing a rib or ribs on that side of the panel. In all cases of the panels of the invention, the boss and ribs are optional and are used when strength or esthetic requirements dictate. Depending on specific applications, the ribs and bosses are trimmed or shaped to fit requirements and, in some cases, are selectively removed in their entirety.

Figure 10B:
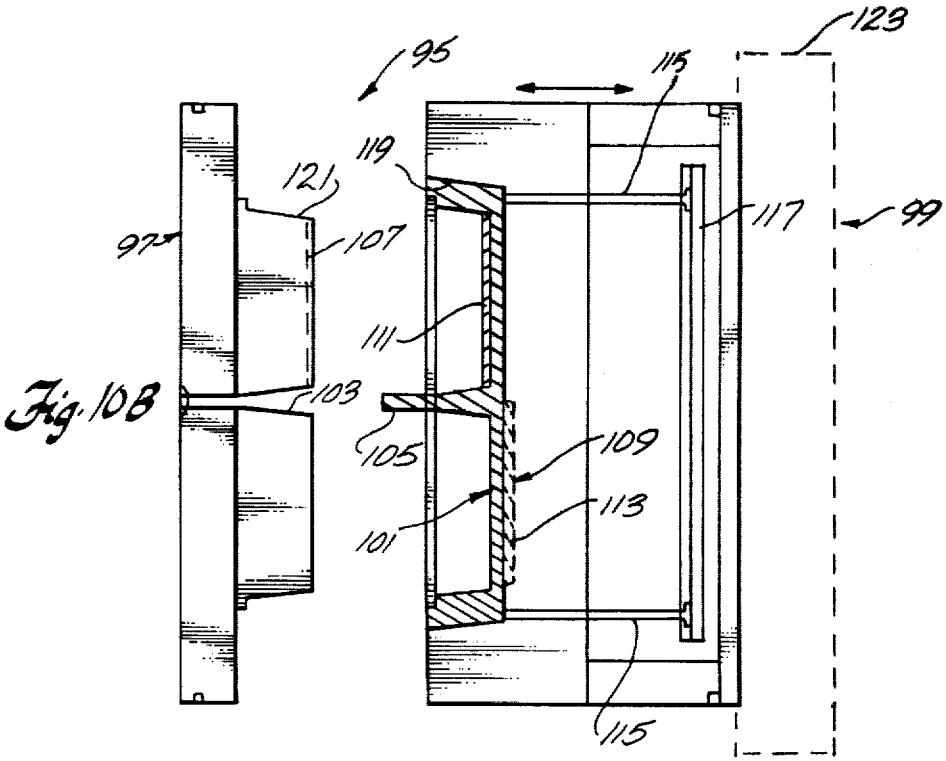
FIG. 10B is a diagrammatic illustration of a mold used for fabrication of the panel according to the present invention having an outwardly-canted flange (positive draft)

An alternate embodiment of a mold for fabricating the panel according to the present invention is shown in FIG. 10B. As shown therein, the mold 95 comprises a stationary hot mold half 97 having a core 121 and a movable ejector mold half 99. The ejector mold half has a configuration similar to mold half 82, except that it is an integral structure without slide blocks defining a cavity 119 and is used in fabricating panels with flanges having their outside surfaces outwardly canted and, therefore, the mold has a positive draft. The molded piece 101 is similar in all respects to the molded piece shown in FIG. 10A, with the exception that the outside surfaces of the flanges are outwardly canted. As in the case of the mold of FIG. 10A, mold half 97 has a sprue hole 103 which results in a boss 105 on panel 101. The two mold halves are provided with runners 107, 109, respectively, which, in turn, result in defining ribs 111 and 113 on selected surfaces of the panel. Ejector pins 115 are provided which operate under impetus from ejector plate 117 to facilitate removal of the finished panel from the mold. Removal is accomplished by moving platen 123 of the molding machine and mold half 99 away from mold half 97. The ejector plate 117 and ejector pins 115 are then actuated to strip the panel from the mold.

The mold of FIG. 10A is typically used for molding panels of the internal flange configuration which are applicable for use with structures of the geodesic type and of the rectangular type. The mold of FIG. 10B is typically used to mold panels of both the internal and the external flange type. For panels of the internal flange configuration, the mold of FIG. 10B is useful for fabrication of rectangular panels and, in the case of panels of the external flange configuration, the mold is useful for fabricating panels for use in both geodesic and rectangular structures.

To facilitate removal of the part from the mold, the insides of the flanges are canted to provide a draft angle of approximately three degrees (3°). The angle of the outside of the flanges is chosen so as to provide the optimum angle for enabling the assembly of the panels in a flange-to-flange arrangement. This angle varies from approximately 0.5° to 5°, depending on the size of the panel and the diameter of the dome. In the preferred embodiment, both the interior and exterior sides are canted and, likewise, the sprue hole has its side walls canted at a draft angle to facilitate removal of the mold half 80.

In the presently preferred embodiment, the panel is constructed of structural foam. Specifically, acrylonitrilebutadiene-styrene copolymer (ABS) is the presently preferred material and provides a panel of great strength and strong flame resistance. In addition to the specifically preferred material, virtually all foamable plastic resins, such as polycarbonates, styrenes and polypropylene can also be used in this application. All such materials can be fabricated in compliance with code and UL flame retardant requirements. In the fabrication of the panel, a foamable resin is mixed with either a physical blowing agent or a chemical blowing agent and is thereafter introduced into a press which forces the foamed plastic through the sprue hole and into the mold cavity.

In the presently preferred embodiment, the peripheral flange 14 of the panel is four inches (4") in width, the base or skin portion 12 of the panel is approximately 0.25 inches thick and the ribs 18,20,22 are 0.375 inches thick. The use of a flange having a depth as specified provides space between the interior of base portion 12 and facing panel 28 for receiving standard thicknesses of insulation. Depending on the specific application for the paneling, the width of the flange is chosen of various dimensions and sizes. A rib of the size indicated corresponds to a mold runner of a size to satisfactorily transmit structural foam to the extremities of the cavity to assure a complete and fully satisfactory injection mold shot.

The present invention is applicable to panels of other geometric shapes, including square and rectangular. A square panel 94 has a face 96. In the embodiment shown in FIGS. 11 and 12, the panel has a flange 98, and extending around the periphery is a shoulder 100 for receiving a facing panel 102. If flange 98 is oriented outwardly, panel 102 forms the outer or exterior surface of the structure. Depending on the orientation of the panel 94 in the structure in which it is used, the flange 98 extends toward the interior or the exterior of the structure.

In the application of the present invention to rectangular or square panels, the angle or canting of flange 98 is very slight, on the order of approximately one-half degree (0.5°). This provides the desired mold draft angle and permits easy removal of the panel from the mold and, at the same time, makes possible assembly of a plurality of panels in a flange-to-flange arrangement. It can be seen from the illustration in FIG. 12 that when the panel 94 is reversed in orientation, the flange 98 extends internally and the facing panel provides an interior surface while the base portion or skin 104 of the panel provides the exterior or outer surface of the structure in which the panel is used. As in the case of the triangular panel, an optional boss 106 may be located approximately in the center of the panel for providing support and a fastening point for the facing panel. The location of the boss corresponds to the location of the sprue by which the structural foam utilized to fabricate the panel is introduced.

Figure 12:
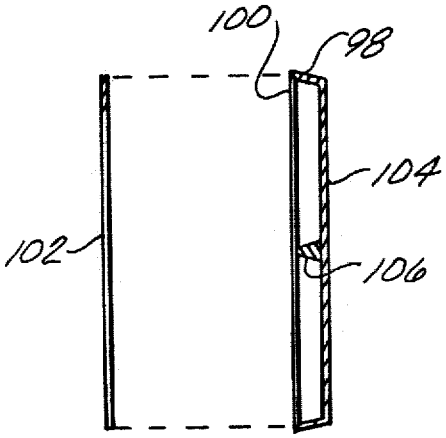
FIG. 12 is a side elevation view of the panel of FIG. 11 and a facing panel used therewith.
Figure 13:
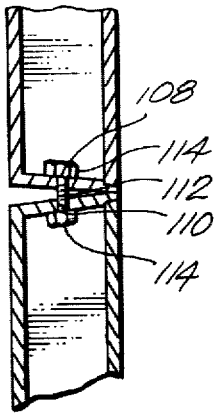
FIG. 13 is a detail view of the method of assembly and attachment of the panels of FIG. 11.

The method of attaching adjacent rectangular or square panels together to form a structure is shown in FIG. 13. As shown therein, the panels are provided with apertures 108,110 through which a bolt fastener 112 is passed. At each end of fastener 112, bolts 114 are applied by a threaded engagement to the bolt to secure adjacent panels together in a flange-to-flange relationship. It can be appreciated that the angle of the flange is exaggerated in FIGS. 12 and 13 for purposes of illustration to clearly show the canting of the flanges. The separation between adjacent flanges having the approximately one-half degree (0.5°) canting defines a total included angle of one degree (1°) between adjacent panels. This minimal amount of spacing can be filled where desired with a sealer or insulating material for added weatherproofing. When the bolt is tightened, the panels are drawn tightly together along a sealing line located along the interior edges of the flanges.

Figure 11:
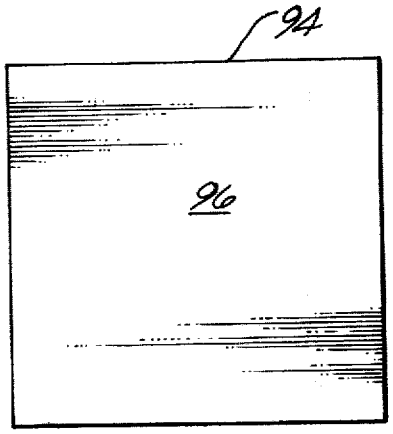
FIG. 11 is a front elevation view of a panel according to the present invention fabricated in a rectangular configuration.
Figure 14:
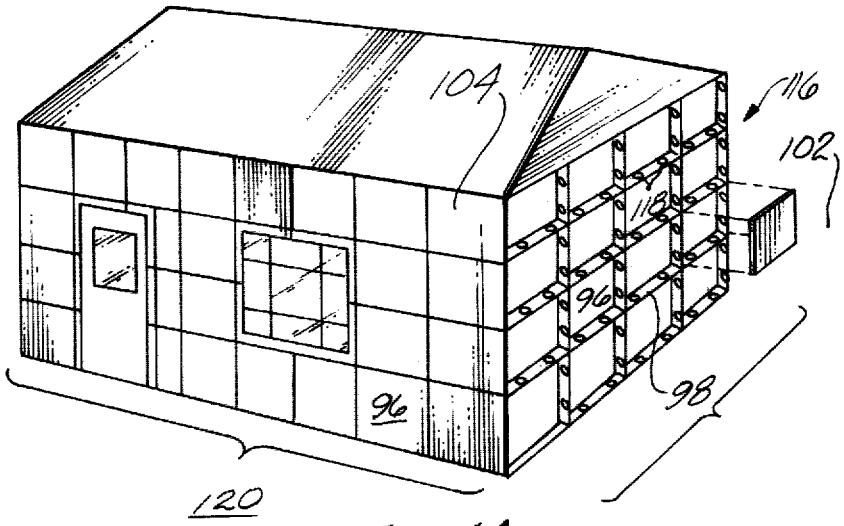
FIG. 14 is a perspective view of a structure utilizing externally and internally flanged rectangular panels.

The panels of FIGS. 11, 12 and 13 are utilized in the erection of conventional square and rectangular structures 120 as is shown in FIG. 14. One one wall is shown a plurality of panels 96 with internal flanges, wherein the base or skin portion 104 provides the exterior surface. Side 116 of structure 120 comprises a plurality of panels 96 having external flanges 98 which are bolted together at apertures 118. To complete the assembly, facing panel 102 is attached to the panels 96 and fitted into shoulder 100 to complete the assembly.

Figure 15A:
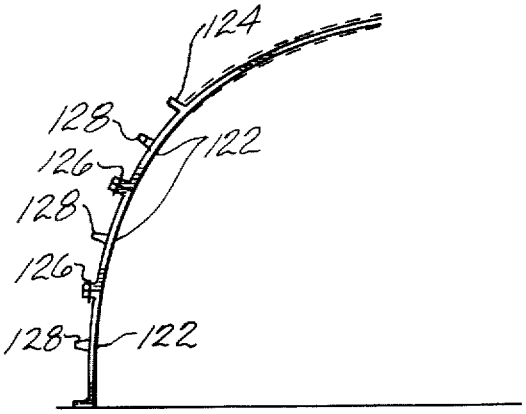
FIG. 15A is a diagrammatic elevation view of the assembly of panels according to FIG. 1 having external flanging.
Figure 15B:
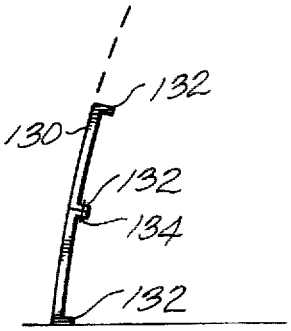
FIG. 15B is a view similar to FIG. 15A utilizing internally flanged panels.

The assembly of internally and externally flanged panels is shown in FIGS. 15A and 15B. In FIG. 15A, panels 122 are externally flanged. In this embodiment, flanges 124 are canted outwardly at an angle of approximately 0.5° to 5°, depending on the size of the panel and the geodesic structure diameter. The angle of between one-half degree (0.5°) and five degrees (5°) provided on the externally flanged version of the panel provides a draft angle for easy disassembly of the mold after the molding step has been completed. The panels are then assembled as shown in FIG. 15A and attached by means of fasteners 126 passed between adjacent mating flanges. Bosses 128 are again optionally provided at the location of the sprue hole in the mold and act as a support for the facing panels which are attached to the outside of the externally flanged panels.

In FIG. 15B, the method of assembling and attaching internally flanged panels is shown. As shown therein, panels 130 have internally directed flanges 132 which are assembled in a flange-to-flange relationship and secured together by means of fasteners 134.

What is claimed is:

1. A structural building module for use in the assembly of geodesic domes, comprising an intergrally molded panel module having:

(a) a triangularly shaped planar base portion;

(b) a continuous peripheral flange formed integrally with and about the entire triangular perimeter of said base portion, said flange extending upwardly on one side of the base portion to define a cavity in said panel module for receiving building insulation therein, (i) the interior side of the flange being canted at a draft angle of approximately 3° from the perpendicular to said base portion, (ii) the exterior side of the flange being canted at a draft angle varying from 0.5° to 5° from the perpendicular to said base portion to facilitate assembly of the panel module with adjacent panel modules in a flange-to-flange arrangement, (iii) the interior side of said flange being stepped adjacent its upper edge to define a continuous shoulder extending peripherally of said cavity for receivably supporting a facing panel thereon to close said cavity, and (iv) a plurality of apertures at predetermined intervals along the flange for receiving fastening means securing the panel module to adjacent modules;

(c) a boss formed integrally with said base portion and disposed centrally thereof, extending upwardly on said one side of said base portion, (i) the outer surface of the boss being canted inwardly toward its upper edge, and (ii) the upper edge of the boss abutting the plane defined by said continuous shoulder for receiving fastening means to secure the facing panel to the panel module; and (d) three ribs formed integrally with said boss, said base portion and said flange, said ribs extending between the boss and each of the three apices defined by the flange with the base portion along the triangular periphery thereof, said ribs imparting strength and rigidity to said panel module.

2. The structural building module of claim 1, further comprising a facing panel supported on the continuous shoulder defined by said flange, and fastening means securing the upper edge of said boss to said facing panel to complete said panel module.

3. A geodesic dome structure, comprising a plurality of the building modules of claim 2, wherein the respective apertures along the flange of each panel module are aligned with corresponding apertures in the flanges of adjacent panel modules; and including fastening means passing through the apertures in said adjacent panel modules for securing said modules in flange-to-flange relationship; and means for securing the resulting structure to a foundation.

* * * * *